US006367209B1

(12) United States Patent
Powers, Jr.

(10) Patent No.: US 6,367,209 B1
(45) Date of Patent: Apr. 9, 2002

(54) BOX LINTEL

(76) Inventor: John Powers, Jr., 5310 S. Wonderview Rd., Phoenix, AZ (US) 85018

( * ) Notice: Subject to any disclaimer, the term of this patent is extended or adjusted under 35 U.S.C. 154(b) by 0 days.

(21) Appl. No.: 09/419,965

(22) Filed: Oct. 18, 1999

(51) Int. Cl.[7] ..... E04C 3/07
(52) U.S. Cl. ..... 52/204.2; 52/677
(58) Field of Search ..... 52/204.2, 677, 52/745.1, 745.2, 731.7

(56) References Cited

U.S. PATENT DOCUMENTS

| | | | | |
|---|---|---|---|---|
| 4,409,764 A | * | 10/1983 | Wilnau | 52/204.2 X |
| 5,138,808 A | * | 8/1992 | Bengtson et al. | 52/204.2 X |
| 5,465,538 A | * | 11/1995 | Powers, Jr. | 52/204.2 |
| 5,907,939 A | * | 6/1999 | Reichel | 52/677 X |

FOREIGN PATENT DOCUMENTS

| | | | | |
|---|---|---|---|---|
| FR | 971849 | * | 1/1951 | 52/204.2 X |
| GB | 2235712 | * | 3/1991 | 52/204.2 X |

* cited by examiner

*Primary Examiner*—Jose V. Chen
*Assistant Examiner*—Michael J. Fisher
(74) *Attorney, Agent, or Firm*—Parsons & Goltry; Robert A. Parsons; Michael W. Goltry

(57) ABSTRACT

A box lintel includes an elongated, hollow metal form with a lower wall, integrally formed side walls extending upwardly therefrom, and integrally formed partial upper walls extending inwardly from the side walls. A method of fabricating a box lintel is also disclosed which includes the steps of providing an elongated flat sheet of metal and bending the flat sheet of metal into a hollow metal form with a lower wall, integrally formed side walls extending upwardly therefrom, and integrally formed partial upper walls extending inwardly from the side walls. The form is adapted to be positioned on upright masonry supports so as to span an opening and to be filled with grout/mortar and to receive one or more courses of masonry bricks on the upper walls.

21 Claims, 4 Drawing Sheets

BOX LINTEL

BACKGROUND OF THE INVENTION

1. Field of the Invention

This invention relates to masonry construction of openings, such as doorways, windows, and the like.

More particularly, the present invention relates to the formation of the lintels of openings, such as doorways, windows, etc., in masonry construction.

In a further and more specific aspect, the instant invention concerns a box lintel and the use of the box lintel in masonry construction.

2. Prior Art

In the prior art, the construction of openings, such as doorways, windows, and the like, in masonry block walls is generally accomplished by forming the wall to approximately the desired height of the opening while defining the sides of the opening with upright lintel supports formed of the masonry blocks. An elongated flat piece of metal is placed between the supports to span the opening. Courses of masonry blocks are then placed on the metal piece and the wall is completed. The problem is that all of the weight of the masonry blocks above the lintel are carried by the metal piece. Therefore, the maximum allowable length of the metal piece and, consequently, the size of the opening, is severely limited. Even with the limitations of size, the metal piece must be extremely rugged and heavy.

In some prior art construction, the entire opening, including the sides and in some instances the threshold, is constructed utilizing a preformed steel frame. One problem with this preformed steel frame is that it can only be purchased in predetermined sizes. Further, the preformed steel frame is extremely heavy and cumbersome to work with. Finally, the appearance of the preformed steel frame is not esthetically pleasing in most instances.

It would be highly advantageous, therefore, to remedy the foregoing and other deficiencies inherent in the prior art.

Accordingly, it is an object of the present invention to provide an improved lintel for openings in masonry walls.

Another object of the present invention is to provide a box lintel which can be easily cut and formed to any desired size.

And another object of the present invention is to provide a box lintel that can be used to form substantially any reasonably sized opening in a masonry wall.

Still another object of the present invention is to provide a box lintel which is sturdier than prior art lintels.

Yet another object of the present invention is to provide a box lintel which is lighter and stronger than prior art lintels.

And still another object of the present invention is to provide a box lintel which is less expensive than prior art lintels.

A further object of the present invention is the provision of an improved method of forming openings in masonry walls using the box lintel.

Still a further object of the present invention is a method of forming openings in masonry walls with the box lintel, which method is simpler and provides a more rugged and esthetically pleasing opening.

And a further object of the present invention is a method of forming a box lintel for use in masonry walls.

SUMMARY OF THE INVENTION

Briefly, to achieve the desired objects of the instant invention, in accordance with a preferred embodiment thereof, a box lintel is first provided which includes an elongated, hollow metal form with a lower wall, integrally formed side walls extending upwardly therefrom, and integrally formed partial upper walls extending inwardly from the side walls. The instant invention also includes a method of fabricating the box lintel, which includes the steps of providing an elongated flat sheet of metal and bending the flat sheet of metal into a hollow metal form with a lower wall, integrally formed side walls extending upwardly therefrom, and integrally formed partial upper walls extending inwardly from the side walls.

The form is adapted to be positioned on upright masonry supports so as to span an opening and to be filled with grout/mortar and to receive one or more courses of masonry bricks on the upper walls. When partially hollow masonry blocks are used in conjunction with the form, the masonry blocks can also be filled with grout/mortar to increase the weight bearing capabilities.

BRIEF DESCRIPTION OF THE DRAWINGS

The foregoing and further and more specific objects and advantages of the instant invention will become readily apparent to those skilled in the art from the following detailed description of preferred embodiments thereof taken in conjunction with the drawings in which.

DETAILED DESCRIPTION OF THE PREFERRED EMBODIMENTS

Figure 1:
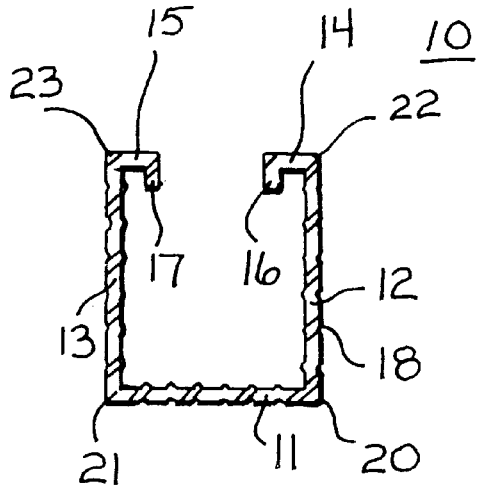
FIG. 1 is a cross-sectional view of a box lintel form in accordance with the present invention.

Turning now to the drawings in which like reference characters indicate corresponding elements, attention is first directed to FIG. 1, which illustrates in cross-section a box lintel in accordance with the present invention. The box lintel includes an elongated, hollow metal form 10 having a lower wall 11, integrally formed side walls 12 and 13 extending upwardly therefrom, and integrally formed partial upper walls 14 and 15 extending inwardly from side walls 12 and 13, respectively. In this specific embodiment, partial upper walls 14 and 15 each end in a short downwardly extending end portion 16 and 17, respectively, which extend generally toward lower wall 11. Downwardly extending end portions 16 and 17 can be omitted in some specific applications, but they are included in this preferred embodiment because of the extra weight bearing characteristics that they add to the box lintel.

Elongated, hollow metal form 10 is constructed with any desired length and may be formed in standard or general lengths which can later be cut to the correct length or can be specially formed with a length required for a specific application. Elongated, hollow metal form 10 is fabricated by bending an elongated metal sheet (preferably steel) longitudinally at substantially a 90° bend, designated 20, between lower wall 11 and side wall 12. A second, parallel, substantially 90° bend, designated 21, is formed between lower wall 11 and side wall 13. Third and fourth substantially 90° bends, designated 22 and 23, are formed between side wall 12 and upper wall 14 and between side wall 13 and upper wall 15, respectively. Each of the bends 20, 21, 22, and 23 are formed parallel to the longitudinal axis of the metal sheet and to each other so as to form a generally rectangularly shaped box. Additional bends are made to form downwardly directed end portions 16 and 17, if they are included. Further, the length of a box lintel can be formed substantially any desired length, predetermined by the size of the opening, by simply fabricating form 10 to the desired length or by fabricating form 10 in a continuous length and cutting it to the predetermined length. It will of course be understood by those skilled in the art that the disclosed preferred method of forming a box lintel is only one method and other methods and structures will occur, as for example forming all of the bends simultaneously, or extruding the steel in the desired form.

As will be explained in more detail presently, hollow metal form 10 is adapted to be filled with grout/mortar and to receive one or more courses of masonry bricks on the upper walls. When the wall is completed some plastering or grout/mortar may be desired on the outer surface to give the masonry opening a more esthetic appearance. To this end the walls of hollow metal form 10 include a regular pattern of small openings 18 therethrough to provide a grip or anchor for mortar/plaster applied to an outer surface of the form. In some specific applications holes 18 may not be needed or desirable (e.g. lintels which are to be simply painted) and in such applications holes 18 may be omitted.

Figure 2:
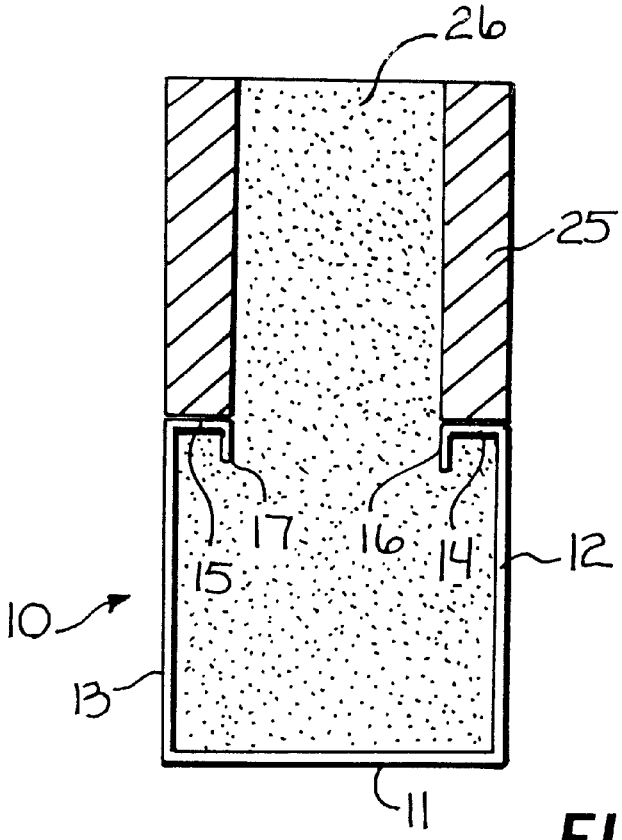
FIG. 2 a cross-sectional view of the box lintel form of FIG. 1n one embodiment of a masonry opening.

Turning to FIG. 2, a sectional view is illustrated of an embodiment of a box lintel, utilizing form 10 of FIG. 1, in accordance with the present invention. For simplicity of the drawing, holes 18 have been omitted in this embodiment. Form 10 is supported on upright supports so as to span the opening being constructed, with lower wall 11 bearing on an upper surface of the upright supports. In a preferred method, a first course of partially hollow masonry blocks 25 is laid on upper surfaces 14 and 15 of form 10. The openings in blocks 25, designated 26, and the opening in form 10 are then filled with grout, mortar, or any convenient masonry material, herein referred to as grout/mortar. It should be understood that in some applications, e.g. when solid bricks are used in the first course, it may be desirable to fill form 10 with grout/mortar and then place the first course of masonry on upper walls 14 and 15, and the steps of laying mortar and filling the openings with grout/mortar can be performed in any desired order that is convenient for the specific application.

Figure 3:
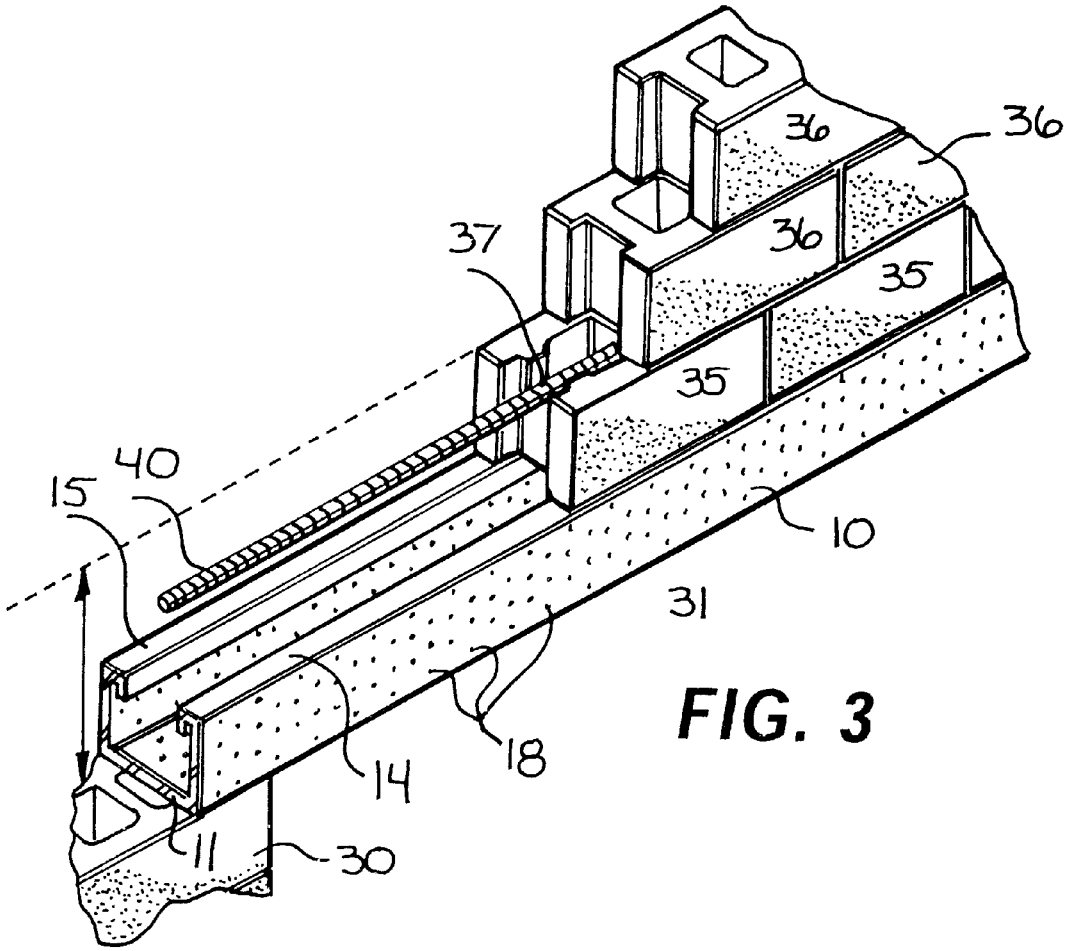
FIG. 3 is an isometric view, portions thereof broken away, of another embodiment of a masonry opening utilizing the box lintel in the construction.
Figure 4:
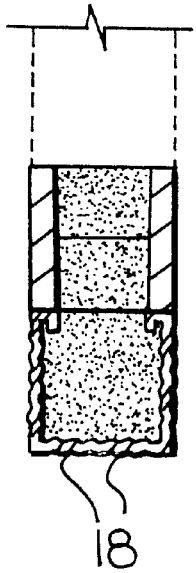
FIG. 4 is a cross-sectional view of a portion of the masonry opening of FIG. 3, illustrating the box lintel.

Turning now to FIGS. 3 and 4, an embodiment is illustrated of a box lintel, utilizing form 10 of FIG. 1, in accordance with the present invention. A pair of upright masonry supports, only one of which is shown and designated 30, are provided to define the sides of an opening 31. Masonry supports 30 are formed of masonry blocks which, in this embodiment are the type molded from concrete, but it will be understood that any of the well known masonry materials can be used. Generally, to form opening 31, courses of masonry blocks are laid to a height desired for opening 31. Upright supports 30 are either formed by the edges of masonry blocks or by additional bearing material (not shown) which may be incorporated in a well known manner.

To complete opening 31, a box lintel is provided, which includes an elongated form 10. Form 10 is of a length to span opening 31 with the lower wall 11 bearing on an upper surface of supports 30, as illustrated in FIG. 3. A plurality of modified masonry blocks 35 are provided along with a plurality of standard masonry blocks 36. Standard masonry blocks 36 are the type having opposed vertical sidewalls, or faces, and a plurality of vertical openings, or air spaces, extending therethrough formed by webbing extending horizontally between the vertical sidewalls. Modified masonry blocks 35 have a channel 37 extending from one end to the other between opposite faces thereof. Essentially, masonry blocks of this type can be purchased or they can be formed by simply removing a portion of the webbing. A first course of masonry blocks 35 are positioned on upper walls 14 and 15 of form 10, as illustrated in FIG. 3. An elongated piece of reinforcing bar 40, or other hard, supporting rod-like material, is positioned in channel 37 and extends the length of form 10, or beyond opening 31. Here it will be understood that the entire course of masonry blocks along the wall need not be formed with modified masonry blocks 35, since masonry blocks 36 will be acceptable once the course extends beyond form 10 and opening 31.

Once this point in the construction is reached, there are a variety of ways to proceed and those skilled in the art will determine the most convenient for the specific application. The vertical openings through masonry blocks 35 and the opening in form 10 are filled with grout/mortar, generally so that the level of grout/mortar is even with the upper surface thereof (shown in FIG. 4), and reinforcing bar 40 is covered and incorporated into the system. In this embodiment a 3000 P.S.I. grout is utilized and sufficient stirring or vibrating is performed to insure that all air pockets are filled. In this fashion, form 10, reinforcing bar 40, masonry blocks 35 and the grout in the openings cooperate to form a solid box lintel system which is extremely strong, even though the individual components are relatively small, light and easy to work with. Further, the box lintel system is relatively inexpensive and can be formed at substantially any reasonable length without requiring special manufacturing or components. In addition, the box lintel system can be constructed utilizing a variety of materials (e.g. different bricks or masonry, etc.) so that it will be esthetically pleasing.

Figure 5:
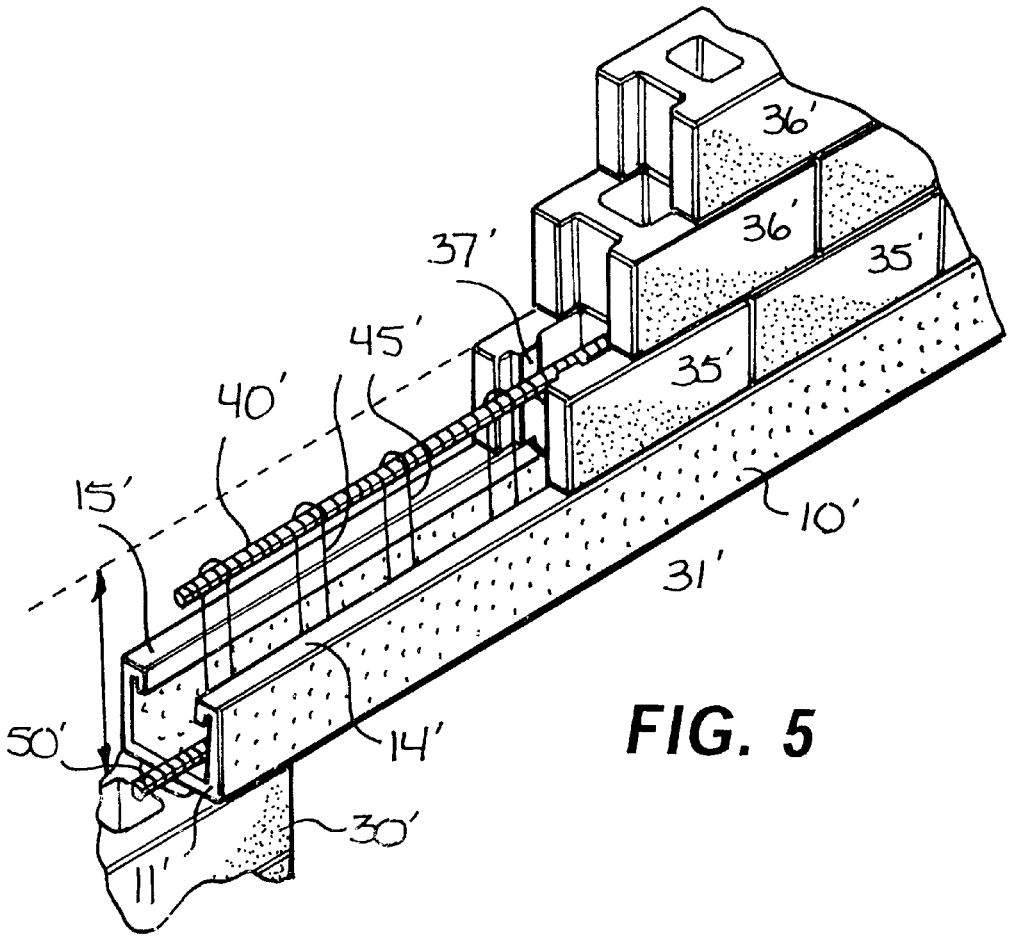
FIG. 5 is an isometric view, portions thereof broken away of another embodiment of a masonry opening utilizing the box lintel in the construction.
Figure 6:
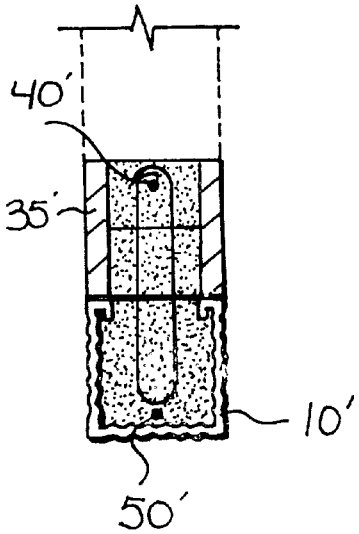
FIG. 6 is a cross-sectional view of a portion of the masonry opening of FIG. 5, illustrating the box lintel.

Turning now to FIGS. 5 and 6, another embodiment is illustrated of a box lintel, utilizing form 10 of FIG. 1, in accordance with the present invention. In this embodiment the basic structure is similar to that described in conjunction with FIGS. 3 and 4 and similar components are designated with similar numbers having a prime added to designate the different embodiment. In this embodiment a plurality of wire stirrups 45' are engaged over reinforcing bar, one stirrup at a time. Each stirrup 45' is formed of a hard wire or rod-like material which can be bent into the desired shape and which, preferably, has some spring or resiliency. In this preferred embodiment, stirrups 45' are formed of 9 gage steel wire. Each stirrup 45' is formed of an elongated piece of wire formed into a continuous loop with reinforcing bar 40' engaged therethrough.

With reinforcing bar 40' in the position illustrated in FIG. 5, each individual stirrup 45' is inserted over reinforcing bar 40' into a vertical opening in one of masonry blocks 35'. While in this specific embodiment stirrups 45' are formed as a continuous loop, it will be understood that stirrups 45' could alternatively be formed with end portions that extend into form 10' and are then directed laterally in any direction. In either instance, it is desirable for stirrup 45' to have some spring or resiliency so that it can be easily positioned and once positioned it is held firmly in place.

In this embodiment a second elongated reinforcing bar 50' is positioned in the bottom of form 10' so as to lie on the upper surface of lower wall 11'. Here it should be understood that additional (or fewer) reinforcing bars can be utilized if desired or deemed necessary for a specific application. The vertical openings through masonry blocks 35' and the opening in form 10' are filled with grout/mortar, generally so that the level of grout/mortar is even with the upper surface thereof (shown in FIG. 6), and reinforcing bars 40', stirrups 45' and reinforcing bar 50' are covered and incorporated into the system. In this embodiment a 3000 P.S.I. grout is utilized and sufficient stirring or vibrating is performed to insure that all air pockets are filled. In this fashion, form 10', reinforcing bars 40' and 50', stirrups 45', masonry blocks 35' and the grout in the openings cooperate to form a solid box lintel system which is extremely strong, even though the individual components are relatively small, light and easy to work with. Further, the box lintel system is relatively inexpensive and can be formed at substantially any reasonable length without requiring special manufacturing or components.

Figure 7:
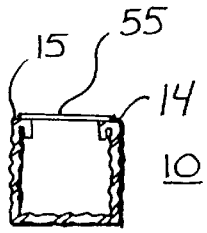
FIG. 7 is a cross-sectional view of another box lintel form in accordance with the present invention.
Figure 8:
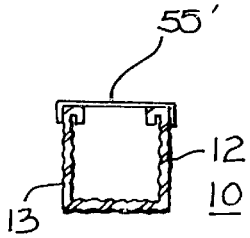
FIG. 8 is a cross-sectional view of another box lintel form in accordance with the present invention.
Figure 9:
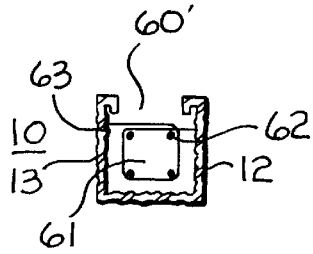
FIG. 9 is a cross-sectional view of another box lintel form in accordance with the present invention.

In each of FIGS. 7, 8, and 9, a hollow metal form is illustrated in cross-section, the form being similar to form 10 in FIG. 1 and, accordingly, similar portions are designated with similar numbers. Referring specifically to FIG. 7, a rod 55 is shown having a downwardly turned leg at each end. Holes are formed in upper walls 14 and 15 and rod 55 is mounted by inserting the downwardly turned legs in the holes. In this fashion rod 55 operates as a stiffener to prevent hollow metal form 10 from expanding when it is filled with grout/mortar. In practice, a rod 55 will be incorporated at convenient spaced apart intervals along an entire length of a box lintel.

As illustrated in FIG. 8, a rod 55' could be constructed to simply engage the outer edges of side walls 12 and 13 to prevent expansion of form 10 during filling and installation. Rod 55', can also include downwardly extending legs that either engage end portions 16 and 17 or extend through holes in upper walls 14 and 15 to prevent inward movement of side walls 12 and 13 during installation.

In a slightly more complicated version, illustrated in FIG. 9, a rod 60 is bent to define a square 61 with legs 62 and 63 extending outwardly from the top so as to engage side walls 12 and 13, respectively. Rod 60 can be attached to side walls 12 and 13 by welding, or by either of the methods discussed in conjunction with FIGS. 7 and 8. In addition to providing stiffening for hollow metal form 10, one or more rebars can be inserted in square 61 to provide additional reinforcement. In the embodiment illustrated in FIG. 9, four rebars, one in each corner of square 61, are provided and can be held in place by welding, wiring, etc.

Figure 10:
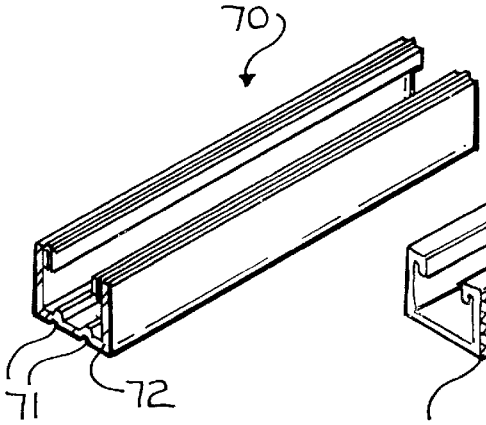
FIG. 10 is an isometric view of another box lintel form in accordance with the present invention.

Turning now to FIG. 10 another embodiment of the hollow metal form, designated 70, is illustrated. In this embodiment form 70 has longitudinally extending corrugations 71 formed in a lower wall 72. Longitudinally extending corrugations 71 provide additional strength in applications where the box lintel may be longer or may require more strength because of the specific application. Here it will be understood that other and/or additional corrugations may be provided, if desired.

Figure 11:
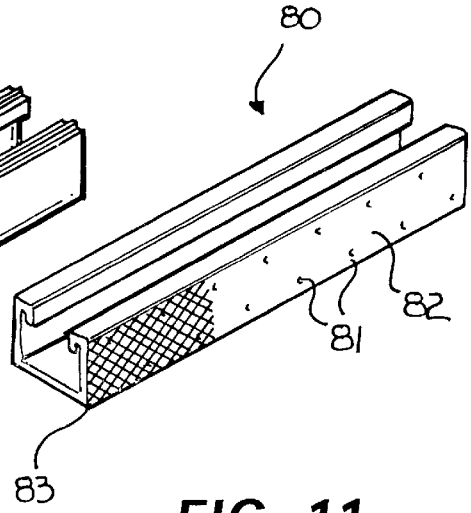
FIG. 11 is an isometric view of another box lintel form in accordance with the present invention.

Turning now to FIG. 11, a hollow metal form 80 is illustrated having holes 81 formed through one of the side walls 82. Holes 81 provide for the convenient installation of a decorative material 83 on the surface of side wall 82. Generally, a surface which will be visible after the completion of construction may include holes 81, but it should be understood that all or other exterior surfaces of hollow metal form 80 can include holes 81, for standardization or for convenience.

Various modifications and changes to the embodiments herein chosen for purposes of illustration will readily occur to those skilled in the art. For example, form 10 and/or the box lintel can be fabricated in a variety of ways while still performing the stated functions. Further, a variety of different masonry materials may be utilized and the walls may be fabricated in a variety of somewhat modified and/or interchanged steps.

The foregoing is given by way of example only. Other modifications and variations may be made by those skilled in the art without departing from the scope of the invention as defined by the following claims.

Having fully described and disclosed the present invention and preferred embodiments thereof in such clear and concise terms as to enable those skilled in the art to understand and practice same, the invention claimed is:

1. A box lintel for masonry walls comprising an elongated, hollow metal form including a lower wall, integrally formed side walls extending upwardly therefrom, and integrally formed partial upper walls extending inwardly from the side walls, the partial upper walls providing a flat upper bearing surface on the entire length thereof with an area approximately equal to the lower surface of a row of abutting masonry bricks in a conventional abutting relationship, the form being adapted to be filled with grout/mortar and to receive masonry bricks on the upper walls.

2. A box lintel as claimed in claim 1 wherein the hollow metal form is fabricated of steel.

3. A box lintel as claimed in claim 2 wherein the hollow metal form is fabricated of an elongate flat sheet of steel and the sheet includes a substantially 90° bend between each side wall and the bottom wall and between each side wall and the partial upper walls.

4. A box lintel as claimed in claim 1 wherein the partial upper walls each end in a short downwardly extending end portion which extends generally toward the lower wall.

5. A box lintel as claimed in claim 1 wherein the lower and side walls have small openings defined therein to provide a grip for mortar/plaster on an outer surface of the form.

6. A box lintel incorporated in a masonry wall comprising:

a masonry wall with an opening therethrough including upright supports in the masonry wall on each side of and defining the opening;

an elongated, hollow metal form having a lower wall, integrally formed side walls extending upwardly therefrom, and integrally formed partial upper walls extending inwardly from the side walls, the partial upper walls providing a flat upper bearing surface on the entire length thereof with an area approximately equal to the lower surface of a row of masonry bricks, the hollow metal form being positioned to span the opening in the masonry wall and to be supported by the upright supports on each side; and the hollow metal form being filled with grout/mortar and having masonry bricks in a conventional butting relationship supported by the bearing surface of the upper walls and defining a portion of the masonry wall.

7. A box lintel incorporated in a masonry wall as claimed in claim 6 including in addition a first course of partially hollow masonry positioned on the upper walls of the form and a first elongated reinforcing bar positioned in the first course of masonry.

8. A box lintel incorporated in a masonry wall as claimed in claim 7 wherein the first course of partially hollow masonry includes masonry blocks of the type having vertical sidewalls and a plurality of vertical openings extending through the masonry blocks.

9. A box lintel incorporated in a masonry wall as claimed in claim 7 including in addition a plurality of stirrups engaged with the first elongated reinforcing bar and hanging through the partially hollow masonry into the form, the plurality of stirrups being formed of steel wire having some spring or resiliency.

10. A box lintel incorporated in a masonry wall as claimed in claim 7 including in addition grout/mortar substantially filling the first course of masonry and surrounding the first elongated reinforcing bar.

11. A box lintel incorporated in a masonry wall as claimed in claim 7 including in addition a second elongated reinforcing bar positioned in the form.

12. A box lintel incorporated in a masonry wall as claimed in claim 6 wherein the lower and side walls have small openings defined therein to provide a grip for mortar/plaster on an outer surface of the form.

13. A method of constructing an opening in a masonry wall utilizing a box lintel comprising the steps of:

forming a partial masonry wall;

forming upright supports in the masonry wall on each side of and defining the opening, the upright supports including a course of masonry having a flat upper surface at approximately a desired height for the opening;

providing an elongated, hollow metal form having a lower wall, integrally formed side walls extending upwardly from the lower wall, and integrally formed partial upper walls extending inwardly from the side walls, the partial upper walls providing a flat upper bearing surface on the entire length thereof with an area approximately equal to the lower surface of a row of masonry bricks;

supporting the form with the lower wall positioned on the flat upper surface of the upright supports, the form being positioned and constructed to span the opening; and in any order, filling the form with grout/mortar and placing at least one course of masonry bricks on the flat upper bearing surface in a conventional abutting relationship of the upper walls of the form.

14. A method of constructing an opening in a masonry wall utilizing a box lintel as claimed in claim 13 wherein the step of placing at least one course of masonry bricks on the upper walls of the form includes utilizing masonry blocks to form a first course.

15. A method of constructing an opening in a masonry wall utilizing a box lintel as claimed in claim 14 wherein the step of utilizing masonry blocks includes utilizing masonry blocks of the type having vertical sidewalls and a plurality of vertical openings extending through the masonry blocks.

16. A method of constructing an opening in a masonry wall utilizing a box lintel as claimed in claim 15 wherein the step of placing at least one course of masonry on the upper walls of the form includes in addition placing an elongated reinforcing bar lengthwise in the first course and filling the first course with grout/mortar.

17. A method of constructing an opening in a masonry wall utilizing a box lintel as claimed in claim 13 including in addition placing an elongated reinforcing bar lengthwise in the form prior to filling the form with grout/mortar.

18. A method of fabricating a box lintel comprising the steps of:

providing an elongated flat sheet of metal; and bending the flat sheet of metal into a hollow metal form including a lower wall, integrally formed side walls extending upwardly from the lower wall, and integrally formed partial upper walls extending inwardly from the side walls, the partial upper walls being formed to provide a flat upper bearing surface on the entire length thereof with an area approximately equal to the lower surface of a row of masonry bricks in a conventional abutting relationship bricks, the form being adapted to be filled with grout/mortar and to receive masonry on the flat upper bearing surface of the partial upper walls.

19. A method of fabricating a box lintel as claimed in claim 18 wherein the step of providing the elongated flat sheet of metal includes providing an elongated flat sheet of steel.

20. A method of fabricating a box lintel as claimed in claim 18 wherein the step of bending the elongated flat sheet of metal includes bending the elongate flat sheet of metal to form a substantially 90° bend, extending parallel to a long axis of the sheet, between each side wall and the lower wall and between each side wall and the partial upper walls.

21. A method of fabricating a box lintel as claimed in claim 20 wherein the step of bending the elongated flat sheet of metal includes bending the partial upper walls so that each partial upper wall ends in a short downwardly extending end portion which extends generally toward the lower wall.

* * * * *